United States Patent [19]

Greetham

[11] Patent Number: 4,964,908

[45] Date of Patent: Oct. 23, 1990

[54] HIGH DENSITY SINTERED FERROUS ALLOYS

[75] Inventor: Geoffrey Greetham, Ipswich, England

[73] Assignee: Manganese Bronze Limited, Ipswich, England

[21] Appl. No.: 391,521

[22] PCT Filed: Nov. 20, 1987

[86] PCT No.: PCT/GB87/00830

§ 371 Date: Jul. 21, 1989

§ 102(e) Date: Jul. 21, 1989

[87] PCT Pub. No.: WO88/03961

PCT Pub. Date: Jun. 2, 1988

[30] Foreign Application Priority Data

Nov. 21, 1986 [GB] United Kingdom ..... 8627846

[51] Int. Cl.[5] ..... C22C 29/02

[52] U.S. Cl. ..... 75/241; 75/246; 419/11; 419/15; 419/25; 419/29; 419/32; 420/12

[58] Field of Search ..... 75/246; 419/38, 11, 419/15, 36, 33, 32; 420/12

[56] References Cited

U.S. PATENT DOCUMENTS 4,032,302 6/1977 Nakamura et al. ..... 75/240

4,121,927 10/1978 Lohman et al. ..... 75/201

*Primary Examiner*—Stephen J. Lechert, Jr.

*Assistant Examiner*—Nina Bhat

*Attorney, Agent, or Firm*—Nixon & Vanderhye

[57] ABSTRACT

Sintered ferrous alloys of at least 90% theoretical density are obtained by sintering a powder mixture containing atomized copper-free ferrous slloy, copper phosphide and, optionally, copper, copper alloy and/or graphite to provide a sintered alloy containing, in percentages by weight, 0.6–2.5% carbon, 2–8% chromium, 4.2–20% copper, 0.5–10% molybdenum, 0.4–1.2 % phosphorus, 1–20% tungsten, 1–5% vanadium, and optionally, up to 12% cobalt, up to 2% manganese and up to 2% nickel and the balance being iron and less than 2% impurities. The % carbon content is in the range CCC % −0.1% to CCC % +0.3% (where CCC % is the calculated carbon content =(CWE/20)−0.4 and CWE=% tungsten content +twice % molybdenum content +six times % vanadium content) and the copper phosphide contains 2 to 14% phosphorus. The sintered compact is cooled at a rate which prevents hardening and can subsequently be machined and/or heat treated.

19 Claims, No Drawings

HIGH DENSITY SINTERED FERROUS ALLOYS

It is well known that in order to obtain good mechanical and physical properties in sintered materials, it is important to attain as high a density in the material as possible. Typical sintered densities of ferrous materials may range from 85% to 95% of the theoretical density of the material. As the density of the sintered material approaches 100% of the theoretical density the improvements in both mechanical and physical properties are dramatic. The reduction in the number of pores left in the material after sintering is recognised as being a prime objective if the material is to attain the best properties attainable for any particular material composition.

This development is concerned with the production of ferrous alloys which are useful due to their high mechanical strength, good wear resistance, toughness, and good high temperature properties. These are generally those ferrous alloys with significant elemental addition such as carbon, chromium, molybdenum, tungsten, vanadium and optionally cobalt and nickel, and possibly also other-carbide forming elements such as niobium and titanium and tantalum. Manganese and silicon usually are present as impurities in the starting materials. The ferrous alloys include some of the stainless steels and also cold and hot-working tool steels, including high speed tool steels.

Methods have been developed to attain high densities in materials produced from ferrous powder, some of which are listed below:

(a) Vacuum sintering of compacted metal powders approximately at the solidus temperature of the alloy This technique has the disadvantages that expensive equipment is required, the through-put is relatively small and cycle times are long. As a consequence, the method is only used for high added value products Additionally, the sintering temperatures are very critical, and typically have to be held at ±2° C. If the temperature is too low, the material does not attain the high density required, and, if the temperature is too high, problems arise due to the changes that take place in the structure of the material.

(b) Hot isostatic pressing. In this technique, the metal powder is subjected to combined pressure and high temperature in order to promote the sintering together of the metal particles. The method has the major disadvantage that the equipment is very expensive, and, like vacuum sintering, the through-put is comparatively low, resulting in an expensive end product.

(c) Infiltration. In order to ensure that the material has as few remaining pores as is possible, the technique of infiltration can be used. The metal powder is first pressed and sintered, at the required temperature to produce a material which still has interconnected pores. The material is then reheated to a temperature above the melting point of an infiltrant which is placed on, or under the porous, sintered material. On melting the infiltrant passes into the pores by capillary action. It is possible to combine the sintering of the matrix and the infiltration in one heating step.

One disadvantage of infiltration is that it is necessary to press a separate infiltrant mass of the correct weight to exactly fill the pores in the porous, sintered material. Consequently, there are usually two, or more, pressings to be made for each component being fabricated by the method, and this leads to extra costs in manufacture. Additionally, if some of the pores are not interconnected with the surface, they are not filled and the pores remain after the infiltration process has been completed. Although high densities can be obtained, they are typically not as high as 98–99% of the theoretical density of the material and pores still exist. Although the infiltration method is used, it has a limited application.

It is clear that there remains a demand for materials that will attain as close to fill theoretical density as is possible during one sintering operation, and that the sintering method should be a low cost operation. Additionally, the powders from which the material is produced should be capable of being formed into the presintered shape also using low cost powder metallurgy technique, and not require expensive special high temperature, or high pressure, capital equipment. Preferably, the powders should themselves be capable of being produced by conventional water atomisation techniques, and not have to be low oxygen containing ones produced by inert gas atomisation, or other pre-compaction treatments.

Sintered materials have now been developed that are at least 95% of their theoretically calculated densities, and normally above 98% theoretical density. The ferrous powders used do not have to be specially gas atomised to keep the oxygen content low, and can be made by normal water atomisation. An additional benefit is that the water atomisation technique usually produces an irregularly powder shape which ensures that the powder has a reasonable green strength when compacted in a die. This means that the compacted powder component can be handled with little risk that it will crumble or break.

The powder is then mixed with other additions, and compacted in a static die. The shaped powder compact is then sintered by heating, usually to a temperature in the range 1080 to 1160C for a period of 15 to 60 minutes in a conventional mesh belt furnace. This heating has to be carried out in an atmosphere that will not oxidise the metal powders, such as dissociated ammonia, ie. a hydrogen/nitrogen atmosphere with a dew-point of below −20.° C., and preferably −40° C.

Following sintering, the compact is cooled at a rate that prevents the structure from hardening. At this stage, the density of the sintered material usually will be at least 98% and possibly 99% of the theoretically calculated density. The material is cooled from the sintering temperature at a rate that prevents the normal hardening associated with these materials, and in its sintered condition, the material can be machined to shape if required. After machining the component can be heat-treated to produce attractive strength and hardness properties.

The ferrous materials of the invention are high speed steels having the following composition range in percentages by weight:

| | |
|---|---|
| C | 0.6–2.5 |
| Cr | 2–8 |
| Mo | 0.5–10 |
| V | 1–5 |
| Co | 0–12 |
| W | 1–20 |
| Mn | 0–2 |
| Ni | 0–2 |
| Cu | 4.5–20 |
| P | 0.4–1.2 |
| Fe | Balance |

wherein the % carbon content is in the range:

CCC%−0.1% to CCC%+0.3%
(where CCC% is the calculated carbon content and is equal to (CWE/20)−0.4, and CWE=% tungsten content + twice % molybdenum content+six times % vanadium content) and the phosphorus is derived from a copper phosphide containing 2 to 14% phosphorus.

The sintered material can be manufactured in the following manner.

An alloyed ferrous based powder is produced by water atomisation of a molten alloy which does not contain any copper, the composition of the atomised alloy being such that with further additions of copper phosphide powder, and optionally copper powder, copper alloy powder, and/or graphite, the composition of the mixed powders conforms to that required, that is to a composition within the composition ranges set above. The atomised ferrous powder can be produced with or without the required carbon level, the necessary carbon level being attained by the addition of graphite. If the carbon is added to the molten alloy before atomisation, it is likely that the atomised powder will have to be annealed to soften it before it is mixed with other powders and compacted in the next stage of the process. The copper phosphide is within the range of 2% to 14% phosphorus, but it is better to use an alloy containing 6% to 11% phosphorus, especially the eutectic composition of 8.4% phosphorus. The eutectic composition is the lowest melting point alloy in the copper-phosphorous system. The closer the composition of the copper-phosphorous alloy is to the eutectic composition, the more low melting point liquid phase will be formed during sintering, and the easier it will be to attain the required high final density on sintering.

The mixed powders are also mixed with a pressing lubricant if required to aid the compaction process, following which the powders are compacted into the required shape. Compaction may be in a conventional die set, or by hydrostatic compaction, for example. The aim of the compaction process should be to subject the powders to a pressure, as uniform as possible of at least 25 tsi (380 MPa), and preferably about 40 tsi (620 MPa). This will produce handleable compacts that are in the density range of approximately 65% to 80% theoretical density depending on the composition of the powder mixture.

Following compaction, the pressing lubricant may be removed in a low temperature heating operation, or alternatively the compacts can be subjected to sintering in a conventional mesh belt furnace operating in an atmosphere of dissociated ammonia with a dew point of below −20° C. and preferably −40° C. Sintering typically may be from 15 to 60 minutes.

After sintering, the compacts will have reduced in volume and attained high densities provided that the composition and sintering temperature have been correctly chosen. The composition and sintering temperature will be chosen having regard to the following guidelines.

The compacted powders sinter to high density due to the provision during sintering of liquid phases. These phases are produced by interaction between the constituents of the alloy powder mixture and hence the constituents are adjusted to give the correct amount of liquid phase at the sintering temperature. If there is too much liquid phase present due to an incorrect choice of composition or due to too high a sintering temperature, the sintered compact will not retain its compacted shape and distortion will result. Additionally, it is likely that the excess liquid phase will be expelled from the sintered compact and form as droplets on the external surface. If the amount of liquid phase is too small cue to an incorrect choice of composition, or if the sintering temperature is too low, the compacted powder will not attain the high density required.

The liquid phases responsible for the high density of the sintered material are formed by the complex interaction of all of the alloying elements present, but some have more influence than others.

Carbon interacts in a complex manner with chromium, phosphorus, iron and molybdenum to give liquid phases at temperatures above about 1050° C. It also interacts with iron, chromium, molybdenum, vanadium and tungsten, to form complex carbides and with all these elements to improve the hardenability of the material. Hardenability is the property of the ferrous material which enables it to be hardened by cooling relatively slowly from a high temperature. This is important in the heat treatment of tool steels, and enables components with large cross-sections to be through hardened easily. The limits are therefore set to ensure that there is sufficient high temperature liquid phase present, and also that there is sufficient carbon to attain the hardenability level desired in the material, and also the amount of carbide phase to provide wear resistance.

Chromium, as stated above acts in conjunction with iron and carbon in particular to form a high melting point liquid phase which assists sintering. Additionally, chromium improves the hardenability of the material and also is able to form complex carbides with iron and other carbide-forming elements present in the material, and consequently is an effective carbide stabiliser. The composition limits aré set in order to provide sufficient liquid phase for sintering, and to ensure that the material has good hardenability and that the carbides formed in the material are stable. The lower limit is set at 2% chromium to ensure efficient sintering and hardenability. Above 8% chromium its effectiveness diminishes.

Phosphorus, as noted above interacts with copper, but can also interact with iron to form low melting point phases. However, their melting points are not as low as those in the copper-phosphorus system, and usually are not as effective. Below 0.4% phosphorus, there is too little liquid phase present to give adequate sintering, and above 1.2% phosphorus, the amount of phosphide in the final structure becomes too high and the mechanical properties of the sintered material begin to deteriorate.

Copper, interacting with phosphorus in particular, provides a low melting point liquid phase which can have a melting point as low as 714° C. In conjunction with iron and manganese, copper forms a useful liquid phase which is often used for the infiltration of ferrous sintered components. Copper itself melts and produces liquid copper at 1083° C. In order to provide sufficient liquid phase, the copper content is within the range 4.5 to 20%, usually 4.5 to 15%. The lower limit is set by the need to introduce phosphorus by means of the copper-phosphorus alloy, and the upper limit is set by the production of too much liquid phase above about 20%. Although the excess copper is expelled from the sintered compact if too much copper is added the density of the sintered material can still be very high. The expelled copper phase however distorts the external shape of the sintered component. In some cases, this might not be of importance, ie. in the production of high density blanks for subsequent machining.

Molybdenum contributes towards the high temperature liquid phase. It also form complex carbide with iron and carbon, and improves the hardenability of the alloy. It is necessary to add more than 0.5% to attain the required hardenability and final hardness in the material. Usually up to 10% may be added to produce the desired hardness after heat treatment.

Other additions, although contributing in a minor way to the production of liquid phases are generally present to enhance mechanical properties.

Vanadium also combines with carbon to form carbides, and also improves hardenability. Up to 5% vanadium is effective.

Tungsten will also form complex carbides with iron and carbon, and strengthens the iron matrix of the material improving its high temperature mechanical properties; consequently alloys with tungsten additions are useful for elevated temperatures uses. Up to 20% tungsten may be usefully added.

Cobalt also strengthens the iron matrix and is used in materials which need to operate at elevated temperatures. Up to 12% cobalt may be usefully added.

Although not essential manganese may be present, either as an impurity in the ferrous alloy powder, or as part of the copper alloy powder addition. Generally manganese promotes sinterability in ferrous alloys. Up to 2% manganese may be usefully added.

Similarly nickel is not an essential additive, but if present it will improve hardenability. Up to 2% nickel may be usefully added.

Alternative carbide forming elements may also be used in place of, or to supplement the effect of molybdenum, vanadium and tungsten as carbide formers.

The following Examples are given in order to illustrate some of the alloy compositions and their respective sintering temperatures.

The majority of the samples prepared in these Examples were solid cylinders nominally of 1 in (2.5 cm) diameter and 0.5 in (1.3 cm) height. Other samples were rings ranging from 1 in (2.5 cm) diameter, 0.75 in (1.9 cm) bore and 0.375 in (0.95 cm) height to 2 in (5 cm) diameter, 1.25 in (3.2 cm) bore and 0.375 in (0.95 cm) height. All were either sintered in cracked ammonia (dew pt −40° C.) in a mesh belt furnace or vacuum sintered in a static tube furnace. The sintering time was 30 minutes and all sintered samples were furnace cooled. In the mesh belt furnace, the cooling was about 27° C./min over the range 1100–400° C. whilst in the vacuum sintering furnace the cooling was about 100° C./min over the same temperature range. The Examples the powders used were as follows:

Powder A

A ferrous alloy containing 1.3%C, 0.5%Co, 4.2%Cr, 0.1%Mn, 5.9%Mo, 0.5%Ni, 0.3%Si, 2.9%V, 6.0%W.

Powder B

A ferrous alloy containing 1.0%C, 0.6%Co, 4.3%Cr, 6.2%Mo, 0.4%Ni, 0.3%Si, 2.8%V, 6.0%W.

Powder C

A ferrous alloy containing 1.0%C, 0.4%Co, 4.3%Cr, 0.2%Si, 3.9%V, 5.8%W.

Powder D

A ferrous alloy containing 1.3%C, 0.5%Co, 4.1%Cr, 0.2%Mn, 5.6%Mo, 0.3%Ni, 0.4%Si, 2.9%V, 6.0%W.

Powder E

A ferrous alloy containing 1.0%C, 4.5%Co, 4.1%Cr, 5.0%Mo, 0.4%Ni, 0.3%Si, 1.9%V, 6.2%W.

Powder F

A ferrous alloy containing 1.6%C, 5.0%Co, 4.4%Cr, 0.2%Mn, 0.6%Mo, 0.1%Ni, 0.3%Si, 4.7%V, 12.4%W.

Powder G

A ferrous alloy containing 1.4%C, 9.4%Co, 4.2%Cr, 0.2%Mn, 3.2%Mo, 0.1%Ni, 0.3%Si, 2.9%V, 8.9%W.

Powder H

Pure molybdenum powder.

Powder I

Pure copper powder.

Powder J

A copper alloy containing 1.0%Mn, 5.0%Fe.

Powder K

A copper alloy containing 8.5%P.

Powder L

A copper alloy containing 14.0%P.

Powder M

Zinc stearate powder.

Powder N

Manganese sulphide powder.

Powders A to G were all commercially available materials used for the production of high density, high speed steels by high temperature sintering. As far as is known, they are all water atomised and annealed powders and were produced from molten alloys of the same composition as the powder.

Powders J, K and L also were prepared by water atomisation.

All powders were −100 mesh (Tyler Standard Sieve; 0.15 mm) particle size but powders K and L were at most −200 mesh (0.07 mm) particle size and preferably −325 mesh (0.04) to ensure good distribution throughout the pre-sintered ferrous alloy powder.

EXAMPLE 1

Powders were mixed in the usual manner in the proportions 89.9%A, 9.4%K and 0.7%M. The density as pressed at 40 tsi (620 MPa) was 75.4%TD (theoretical density) and, after sintering at 1120° C., or 1150° C., the sintered densities were 95.1%TD and 97.8%TD respectively,

EXAMPLE 2

Example 1 was repeated but using powders in the proportions 83.5%A, 9.4%K, 6.4%I, and 0.7%M. The density as pressed at 40 tsi (620 MPa) was 75.5.TD and, after sintering at 1120° C., 1150° C. or 1175° C., the sintered densities were 98.5%TD, 98.9%TD and 99.4%TD respectively.

EXAMPLE 3

(Comparative - excessive Cu)

Example 1 was repeated but using powders 73.7%A, 9.4%K, 16.4%I, 0.7%M. The density as pressed at 40 tsi (620 MPa) was 78.5%TD and, after sintering at 1120° C. and 1150° C. the sintered densities were both 100%TD. In this case there was some copper expelled from the sintered sample.

EXAMPLE 4

Example 1 was repeated but using powders in the proportions 83.3%A, 11.8%K, 4.2%I, 0.7%M. The density as pressed at 40 tsi (620 MPa) was 75.5%TD and, after sintering at 1120° C., or 1150° C., the sintered densities were 98.9%TD or 99.3%TD respectively.

EXAMPLE 5

Example 1 was repeated but using powders in the proportions 83.7%A, 7.1%K, 8.5%I, 0.7%M. The density as pressed at 40 tsi (620 MPa) was 76.5%TD and, after sintering at 1120° C. or 1150° C., the sintered densities were 97.3%TD and 99.4%TD respectively.

EXAMPLE 6

Example 1 was repeated but using powders in the proportions 85.8%A, 7.1.%K, 6.4%I, 0.7%M. The density after pressing at 40 tsi (620 MPa) was 76.8%TD and, after sintering at 1120° C., or 1150° C., the sintered densities were 94.3%TD or 98.4%TD respectively.

EXAMPLE 7

Example 1 was repeated but using powders in the proportions 83.5%A, 9.4%K, 0.7%M, 6.4%I. The density after pressing at 40 tsi (620 MPa) was 76.2%TD and, after sintering at 1120° C. or 1150° C., the sintered densities were 98.2%TD and 99.4%TD respectively.

EXAMPLE 8

(Comparative - insufficient C)

Example 1 was repeated but using powders in the proportions 89.9%B, 9.4%K, 0.7%M. The density after pressing at 40 tsi (620 MPa) was 76.3%TD and, after sintering at 1120° C., 1150° C. or 1175° C., the sintered densities were 87.8%TD, 92.6%TD and 97.9%TD respectively.

EXAMPLE 9

(Comparative - insufficient C)

Example 1 was repeated but using powders in the proportions 83.5%B, 9.4%K, 6.4%I, 0.7%M. The density after pressing at 40 tsi (620 MPa) was 77.2%TD and after sintering at 1120° C., 1150° C. or 1175° C., the sintered densities were 90.2%TD, 97.7%TD and 97.9TD respectively.

EXAMPLE 10

Example 1 was repeated but using powders in the proportions 83.0%B, 9.4%K, 6.4%I, 0.7%M, 0.5% graphite. The density after pressing at 40 tsi (620 MPa) was 77.7%TD and, after sintering at 1120° C. or 1150° C., the sintered densities were 98.5%TD and 98.6%TD respectively.

EXAMPLE 11

(Comparative - insufficient C)

Example 1 was repeated but using powders in the proportions 89.9%C, 9.4%K, 0.7%M. The density after pressing at 40 tsi (620 MPa) was 78.2%TD and, after sintering at 1120° C. or 1150° C., the sintered densities were 84.2%TD and 89.0%TD respectively.

EXAMPLE 12

(Comparative - insufficient C)

Example 1 was repeated but using powders in the proportions 83.5%C, 9.4%K, 6.4%I, 0.7%M. The density after pressing at 40 tsi (620 MPa) was 79.6%TD and, after sintering at 1120° C. and 1150° C., the sintered densities were 86.6%TD and 95.0%TD respectively.

EXAMPLE 13

Example 1 was repeated but using powders in the proportions 83.0%C, 9.4%K, 6.4%I, 0.7%M, 0.5% graphite. The density after pressing at 40 tsi (620 MPa) was 78.9%TD and, after sintering at 1120° C. and 1150° C., the sintered densities were 94.1%TD and 99.1%TD respectively.

EXAMPLE 14

Example 1 was repeated but using powders in the proportions 89.9%D, 9.4%K, 0.7%M. The density after pressing at 40 tsi (620 MPa) was 76.0%TD and, after sintering at 1120° C., 1150° C. and 1175° C., the densities were 89.8%TD, 95.8%TD and 99.4%TD respectively.

EXAMPLE 15

Example 1 was repeated but using powders in the proportions 83.5%D, 9.4%K, 6.4%I, 0.7%M. The density after pressing at 40 tsi (620 MPa) was 77.8%TD and, after sintering at 1120° C. and 1150° C., the sintered densities were 96.8%TD and 99.0%TD respectively.

EXAMPLE 16

Example 1 was repeated but using powders in the proportions 89.9%E, 9.4%K, 0.7%M. The density after pressing at 40 tsi (620 MPa) was 76.3%TD and, after sintering at 1120° C., 1150° C. and 1175° C., the sintered densities were 92.7%TD, 98.3%TD and 99.1%TD respectively.

EXAMPLE 17

Example 1 was repeated but using powders in the proportions 83.5%E, 9.4%K, 6.4%I, 0.7%M. The density after pressing at 40 tsi (620 MPa) was 77.1%TD and, after sintering at 1120° C. and 1150° C., the sintered densities were 97.0%TD and 99.3%TD respectively.

EXAMPLE 18

Example 1 was repeated but using powders in the proportions 89.9%F, 9.4%K and 0.7%M. The density after pressing at 40 tsi (620 MPa) was 73.9%TD and, after sintering at 1120° C., 1150° C. and 1175° C., the sintered densities were 92.8%TD, 97.6%TD and 98.4%TD respectively.

EXAMPLE 19

Example 1 was repeated but using powders in the proportions 83.5%F, 9.4%K, 6.4%I, 0.7%M. The density after pressing at 40 tsi (620 MPa) was 75.2%TD and, after sintering at 1120° C. and 1150° C., the sintered densities were 97.8%TD and 100%TD.

EXAMPLE 20

Example 1 was repeated but using powders in the proportions 89.9%G, 9.4%K, 0.7%M. The density after pressing at 40 tsi (620 MPa) was 75.8%TD and, after sintering at 1120° C. and 1150° C., the sintered densities were 96.8%TD and 99.6%TD respectively.

EXAMPLE 21

Example 1 was repeated but using powders in the proportions 83.5%G, 9.4%K, 6.4%I, 0.7%M. The density after pressing at 40 tsi (620 MPa) was 76.6%TD and, after sintering at 1120° C. and 1150° C., the sintered densities were both 100%TD.

EXAMPLE 22

Example 1 was repeated but using powders in the proportions 92.2%A, 7.1%K, 0.7%M. The density after pressing at 40 tsi (620 MPa) was 75.2%TD and, after sintering at 1150° C., the sintered density was 82.1%TD.

EXAMPLE 23

(Comparative - no phosphorus)

Example 1 was repeated but using powders in the proportions 84.3%A, 15%I, 0.7%M. The density after pressing at 40 tsi (620 MPa) was 76.3%TD and, after sintering at 1120° C. and 1175° C., the densities were 77.5%TD and 86.3%TD respectively.

EXAMPLE 24

Example 1 was repeated but using powders in the proportions 83.5%E, 5.7%L, 10.1%I, 0.7%M. The density after pressing at 40 tsi (620 MPa) was 78.8%TD and, after sintering at 1120° C. and 1150° C., the sintered densities were 92.3%TD And 98.3%TD respectively.

The calculated compositions of the sintered alloys in the Examples above are set forth in Table I.

TABLE I

| Ex. | C | Co | Cr | Mn | Mo | Ni | Si | V | W | Cu | P | Fe |
|---|---|---|---|---|---|---|---|---|---|---|---|---|
| 1 | 1.2 | 0.4 | 3.8 | 0.1 | 5.3 | 0.4 | 0.3 | 2.6 | 5.4 | 8.6 | 0.8 | BAL |
| 2 | 1.1 | 0.4 | 3.5 | 0.1 | 4.9 | 0.4 | 0.3 | 2.4 | 5.0 | 15.0 | 0.8 | BAL |
| 3* | 1.0 | 0.4 | 3.1 | 0.1 | 4.3 | 0.4 | 0.2 | 2.1 | 4.4 | 25.0 | 0.8 | BAL |
| 4 | 1.1 | 0.4 | 3.5 | 0.1 | 4.9 | 0.4 | 0.2 | 2.4 | 5.0 | 15.0 | 1.0 | BAL |
| 5 | 1.1 | 0.4 | 3.5 | 0.1 | 4.9 | 0.4 | 0.3 | 2.4 | 5.0 | 15.0 | 0.6 | BAL |
| 6 | 1.1 | 0.4 | 3.6 | 0.1 | 5.1 | 0.4 | 0.3 | 2.5 | 5.1 | 12.9 | 0.6 | BAL |
| 7 | 1.1 | 0.4 | 3.5 | 0.1 | 4.9 | 0.4 | 0.3 | 2.4 | 5.0 | 15.0 | 0.8 | BAL |
| 8* | 0.9 | 0.5 | 3.9 | — | 5.6 | 0.4 | 0.3 | 2.5 | 5.4 | 8.6 | 0.8 | BAL |
| 9* | 0.8 | 0.5 | 3.6 | — | 5.2 | 0.3 | 0.3 | 2.3 | 5.0 | 15.0 | 0.8 | BAL |
| 10 | 1.3 | 0.5 | 3.6 | — | 5.1 | 0.3 | 0.2 | 2.3 | 5.0 | 15.0 | 0.8 | BAL |
| 11* | 0.9 | 0.4 | 3.9 | 0.2 | 5.2 | 0.3 | 0.2 | 3.5 | 5.2 | 8.6 | 0.8 | BAL |
| 12* | 0.8 | 0.3 | 3.6 | 0.2 | 4.8 | 0.3 | 0.2 | 3.3 | 4.8 | 15.0 | 0.8 | BAL |
| 13 | 1.3 | 0.3 | 3.6 | 0.2 | 4.8 | 0.2 | 0.2 | 3.2 | 4.8 | 15.0 | 0.8 | BAL |
| 14 | 1.2 | 0.4 | 3.7 | 0.2 | 5.0 | 0.3 | 0.4 | 2.6 | 5.4 | 8.6 | 0.8 | BAL |
| 15 | 1.1 | 0.4 | 3.4 | 0.2 | 4.7 | 0.3 | 0.3 | 2.4 | 5.0 | 15.0 | 0.8 | BAL |
| 16 | 0.9 | 4.0 | 3.7 | — | 4.5 | 0.4 | 0.3 | 1.7 | 5.6 | 8.6 | 0.8 | BAL |
| 17 | 0.8 | 3.8 | 3.4 | — | 4.2 | 0.3 | 0.3 | 1.6 | 5.2 | 15.0 | 0.8 | BAL |
| 18 | 1.4 | 4.5 | 4.0 | 0.2 | 0.5 | 0.1 | 0.3 | 4.2 | 11.1 | 8.6 | 0.8 | BAL |
| 19 | 1.3 | 4.2 | 3.7 | 0.2 | 0.5 | 0.1 | 0.3 | 3.9 | 10.4 | 15.0 | 0.8 | BAL |
| 20 | 1.3 | 8.5 | 3.8 | 0.2 | 2.9 | 0.1 | 0.3 | 2.6 | 8.0 | 8.6 | 0.8 | BAL |
| 21 | 1.2 | 7.8 | 3.5 | 0.2 | 2.7 | 0.1 | 0.3 | 2.4 | 7.4 | 15.0 | 0.8 | BAL |
| 22 | 1.2 | 0.5 | 3.9 | 0.1 | 5.4 | 0.5 | 0.3 | 2.7 | 5.5 | 6.5 | 0.6 | BAL |
| 23* | 1.1 | 0.4 | 3.5 | 0.1 | 5.0 | 0.4 | 0.3 | 2.4 | 5.1 | 15.0 | 0.0 | BAL |
| 24 | 0.8 | 3.8 | 3.4 | — | 4.2 | 0.3 | 0.3 | 1.6 | 5.2 | 15.0 | 0.8 | BAL |

*Comparative Example

The various effects obtained by the additions and sintering conditions as illustrated by the Examples are as follows: Effect of copper additions—Examples 1, 2, 5 and 3. Below 8%Cu, the densities tend to fall and above about 20% excess copper is expelled from the sintered compact.

Effect of phosphorus additions—Examples 2, 4 and 23. If no phosphorus is present the sintered density is low. A phosphorus content of 0.8% is about the optimum amount.

Effect of cobalt—Examples 9 and 21. These show that the cobalt content can be within wide limits and still allow high densities to be obtained.

Effect of molybdenum—Examples 13 and 19. These also show that the molybdenum content can vary within wide limits.

Effect of vanadium—Examples 17 and 19. These show that the vanadium content can also be varied within wide limits.

Effect of tungsten—Examples 4 and 19. These show that the tungsten content can be varied within wide limits and still allow high densities to be attained.

Effect of type of phosphorus addition—Examples 17 and 24. The material containing the Cu-8.5%P addition attains a higher density than that containing the Cu-14%P addition.

Effect of sintering temperature—Examples 2 and 8. The general effect, well known in sintering, is shown, that the higher sintering temperatures in general produce higher density materials at equal sintering times.

Effect of carbon. The effect of carbon has to be treated separately as it has been found that the carbon content has to be well controlled if high densities are to be achieved. All of the materials have addition elements that are strong carbide-formers, that is they form stable compounds with carbon. As the carbon addition, together with the phosphorus addition in particular is responsible for the production of the liquid phase which promotes the sintering of the material to high density, there has to be carbon in the material in excess of that required to form compounds with the molybdenum, vanadium and tungsten additions. For simplicity a tungsten equivalent (CWE) has been calculated for all of the materials on the basis of:

$$CWE = \%W + 2x\%Mo + 6x\%V$$

The calculated carbon content (CCC%) can then be calculated on the basis of the CWE as follows:

$$CCC\% = (CWE/20) - 0.4$$

The carbon content should be in the range CCC% −0.1% to CCC% +0.3% to yield high density material. However, it should be understood that this method of calculation is not completely accurate and is to be used as a first guide to establishing the correct carbon content for the particular powders being used.

It has also been found that a minimum carbon content of about 0.6% is necessary.

Examples of the effect of carbon content are shown in Examples 12 and 13; Examples 9 and 10; and Examples 2, 9 and 15, which sets of Examples show similar powder compositions with differing carbon contents. When the carbon content is above the minimum CCC% high densities result. It is also noticeable that, when the carbon contents are too low, the effect of sintering temperature is very pronounced, see Examples 9 and 12.

The following Table II provides data from some of the Examples illustrating the need to maintain the carbon level above the CCC%. Table III provides corresponding data from the remaining Example.

TABLE II

| Example No. | CWE | % C | CCC % | Sintering Temperature °C. | % TD |
|---|---|---|---|---|---|
| 2 | 29.3 | 1.1 | 1.1 | 1120 | 98.5 |
| | | | | 1150 | 98.9 |
| | | | | 1175 | 99.4 |
| 7 | 29.3 | 1.1 | 1.1 | 1120 | 98.2 |
| | | | | 1150 | 99.4 |
| 9* | 29.5 | 0.8 | 1.1 | 1120 | 90.2 |
| | | | | 1150 | 97.7 |
| | | | | 1175 | 97.9 |
| 10 | 29.1 | 1.3 | 1.1 | 1120 | 98.5 |
| | | | | 1150 | 98.6 |
| 12* | 34.1 | 0.8 | 1.3 | 1120 | 86.6 |
| | | | | 1150 | 95.0 |
| 13 | 33.9 | 1.3 | 1.3 | 1120 | 94.1 |
| | | | | 1150 | 99.1 |
| 15 | 28.8 | 1.1 | 1.0 | 1120 | 96.8 |
| | | | | 1150 | 99.0 |
| 16 | 24.8 | 0.9 | 0.8 | 1120 | 92.7 |
| | | | | 1150 | 98.3 |
| | | | | 1175 | 99.1 |
| 17 | 23.1 | 0.8 | 0.8 | 1120 | 97.0 |
| | | | | 1150 | 99.3 |
| 18 | 37.7 | 1.4 | 1.5 | 1120 | 92.8 |
| | | | | 1150 | 97.6 |
| | | | | 1175 | 98.4 |
| 19 | 34.8 | 1.3 | 1.3 | 1120 | 97.8 |
| | | | | 1150 | 100 |
| 20 | 29.4 | 1.3 | 1.1 | 1120 | 96.8 |
| | | | | 1150 | 99.6 |
| 21 | 27.2 | 1.2 | 1.0 | 1120 | 100 |
| | | | | 1150 | 100 |

*Comparative Examples

TABLE III

| Example No. | CWE | % C | % CCC | Sintering Temperature °C. | % TD |
|---|---|---|---|---|---|
| 1 | 31.6 | 1.2 | 1.2 | 1120 | 95.1 |
| | | | | 1150 | 97.8 |
| 3* | 26.0 | 1.0 | 0.9 | 1120 | 100 |
| | | | | 1150 | 100 |
| 4 | 29.2 | 1.1 | 1.1 | 1120 | 98.9 |
| | | | | 1150 | 99.3 |
| 5 | 29.6 | 1.1 | 1.1 | 1120 | 97.3 |
| | | | | 1150 | 99.4 |
| 6 | 30.2 | 1.1 | 1.1 | 1120 | 94.3 |
| | | | | 1150 | 98.4 |
| 8* | 31.5 | 0.9 | 1.2 | 1120 | 87.8 |
| | | | | 1150 | 92.6 |
| | | | | 1175 | 97.9 |
| 11* | 36.6 | 0.9 | 1.4 | 1120 | 84.2 |
| | | | | 1150 | 89.0 |
| 14 | 31.1 | 1.2 | 1.2 | 1120 | 89.8 |
| | | | | 1150 | 95.8 |
| | | | | 1175 | 99.4 |

TABLE III-continued

| Example No. | CWE | % C | % CCC | Sintering Temperature °C. | % TD |
|---|---|---|---|---|---|
| 22 | 32.4 | 1.2 | 1.2 | 1150 | 82.1 |
| 23* | 29.7 | 1.1 | 1.1 | 1120 | 77.5 |
| | | | | 1175 | 86.3 |
| 24 | 23.1 | 0.8 | 0.8 | 1120 | 92.3 |
| | | | | 1150 | 98.3 |

*Comparative Examples

All of the materials in Table II contain 8.6% (Examples 16, 18 and 20) or 15%Cu (remaining Examples in the table) and 0.8%P.

Once the correct carbon content has been established the material is also very tolerant of initial pressed density. For example a powder mixture as in Example 2 was pressed to differing initial densities and sintered at 1120° C. with the following results.

| Initial Density As Pressed. % TD | Final Density As Sintered. % TD |
|---|---|
| 63.0 | 96.1 |
| 67.3 | 95.6 |
| 69.9 | 95.9 |
| 72.2 | 97.6 |
| 74.8 | 98.1 |
| 76.2 | 98.9 |

After sintering the materials have a hardness of about 55 RA (Rockwell A) to 75RA and are machinable. The structure of the various materials can best be described as being a matrix of a high speed tool steel which contains almost all of the C, Cr, V, Mo, W and Co additions, some of which are combined to form carbides, together with discrete areas of a copper rich phase, and a small quantity of a phosphide phase. The proportions of these three major constitutents will depend upon the composition of the starting powder mixture. This structure is amenable to heat treatment and can be heat treated in a manner well known for the heat treatment of high speed tool steels.

The heat treatment given will depend upon the composition of the ferrous alloy and guidance can be obtained from standard text books. Generally the heat treatment consists of a solution treatment at a high temperature, followed by cooling at a sufficiently rapid rate to induce the formation of martensite in the high speed tool steel matrix of the sintered material. This is then followed by single or multiple heat tempering treatments to produce the required hardness and toughness in the material. After heat treatment, hardnesses of at least 78RA can be attained.

The materials described have high density, good wear resistance, and high strength at elevated temperatures and consequently can be considered for all applications that conventional high speed tool steels are currently used for. These include such applications as forming tools, jigs and fittings, wear resistant components, cutting tools, and valve seat inserts for automobile engines.

It should be noted that sintering can also be carried out in a vacuum, and that if sintering temperatures greater than 1160° C. can be tolerated materials can be sintered at higher temperatures. Generally high densities can be attained with the content of phosphorus and copper towards the lower end of the range specified.

If required an addition of a free machining agent such as manganese sulphide may be added to improve machinability. It is usually added in quantities of about 0.5%.

In summary, high speed tool steel material with densities at least 98%TD can be produced by adjusting the composition of the starting materials in such a manner that the final composition falls within the specified range. In particular, the carbon content has to be at least equal to the CCC% to obtain the best results, and the phosphorus addition is best achieved by an addition of copper-8.5% phosphorus alloy. The combination of carbon, phosphorus, and the alloying additions ensure that a high density is attained even after sintering at temperatures below 1160C. The materials can then be heat treated in a manner similar to conventionally produced high speed tool steel to achieve, in particular, the hardness required for the application.

I claim:

1. A sintered high speed steel of at least 95% theoretical density consisting essentially of, in percentages by weight:

| | |
|---|---|
| carbon | 0.6–2.5% |
| chromium | 2–8% |
| copper | 4.5–20% |
| molybdenum | 0.5–10% |
| phosphorus | 0.4–1.2% |
| tungsten | 1–20% |
| vanadium | 1–5% |
| cobalt | 0–12% |
| manganese | 0–2% |
| nickel | 0–2% |

the balance being iron and less than 2% by weight impurities, wherein the molybdenum, tungsten and vanadium contents are such that the % carbon content is in the range CCC%−0.1% to CCC%+0.3%, where CCC% is the calculated carbon content=(CWE/20)−0.4 and CWE=% tungsten content+twice % molybdenum content+six times % vanadium content, and wherein the phosphorus is derived from a copper phosphide containing 2 to 14% phosphorus.

2. An alloy as claimed in claim 1, consisting essentially of, in percentages by weight:

| | |
|---|---|
| carbon | 0.8–1.5% |
| chromium | 3–4% |
| copper | 8–15% |
| molybdenum | 3–5% |
| phosphorus | 6–0.8% |
| tungsten | 5–10% |
| vanadium | 2–4% |
| cobalt | 0.5–8.5% |
| manganese | 0.1–0.2% |
| nickel | 0.1–0.4% |

the balance being iron and less than 2% by weight impurities.

3. An alloy as claimed in claim 1, wherein the density is at least 98% theoretical density.

4. An alloy as claimed in claim 1, wherein the copper phosphide contains 6 to 11% phosphorus.

5. An alloy as claimed in claim 4, wherein the copper phosphide contains 8% phosphorus.

6. A powder mixture comprising an atomized copper-free ferrous alloy powder and copper phosphide powder, which mixture when compressed and sintered provides a sintered ferrous alloy consisting essentially of, in percentages by weight:

| | |
|---|---|
| carbon | 0.6–2.5% |
| chromium | 2–8% |
| copper | 4.5–20% |
| molybdenum | 0.5–10% |
| phosphorus | 0.4–1.2% |
| tungsten | 1–20% |
| vanadium | 1–5% |
| cobalt | 0–12% |
| manganese | 0–2% |
| nickel | 0–2% |

the balance being iron and less than 2% by weight impurities, wherein the molybdenum, tungsten and vanadium contents are such that the % carbon content is in the range CCC%−0.1% to CCC%+0.3%, where CCC% is the calculated carbon content=(CWE/20)−0.4 and CWE=%tungsten content+twice % molybdenum content+six times % vanadium content, and wherein the copper phosphide contains 2to 14% phosphorus.

7. A powder mixture as claimed in claim 6, which mixture when compressed and sintered provides a sintered ferrous alloy consisting essentially of, in percentages by weight:

| | |
|---|---|
| carbon | 0.8–1.5% |
| chromium | 3–4% |
| copper | 8–15% |
| molybdenum | 3–5% |
| phosphorus | 0.6–0.8% |
| tungsten | 5–10% |
| vanadium | 2–4% |
| cobalt | 0.5–8.5% |
| manganese | 0.1–0.2% |
| nickel | 0.1–0.4% |

the balance being impurities.

8. A powder mixture as claimed in claim 7, wherein the copper phosphide contains 8 to 11% phosphorus.

9. A powder mixture as claimed in claim 8, wherein the copper phosphide contains 8% phosphorus.

10. A powder mixture as claimed in claim 6, wherein the ferrous alloy powder has been formed by water atomization of a molten copper-free ferrous alloy.

11. A process of manufacturing a sintered alloy article, which process comprises mixing atomized copper-free ferrous alloy powder and copper phosphide powder, compressing the powder mixture into a shaped article and sintering said article, wherein the powder mixture when compressed and sintered provides a sintered ferrous alloy consisting essentially of, in percentages by weight:

| | |
|---|---|
| carbon | 0.6–2.5% |
| chromium | 2–8% |
| copper | 4.5–20% |
| molybdenum | 0.5–10% |
| phosphorus | 0.4–1.2% |
| tungsten | 1–20% |
| vanadium | 1–5% |
| cobalt | 0–12% |
| manganese | 0–2% |
| nickel | 0–2% |

the balance being iron and less than 2% by weight impurities, wherein the molybdenum, tungsten and vanadium contents are such that the % carbon is in the range CCC%−0.1% to CCC%+0.3%, where CCC% is the calculated carbon content=(CWE/20)−0.4 and CWE=% tungsten content+twice % molybdenum content+six times % vanadium content, and wherein the copper phosphide contains 2 to 14% phosphorus.

12. A process a claimed in claim 11, wherein the powder mixture when compressed and sintered provides a sintered ferrous alloy consisting essentially of, in percentages by weight:

| | |
|---|---|
| carbon | 0.8–1.5% |
| chromium | 3–4% |
| copper | 8–15% |
| molybdenum | 3–5% |
| phosphorus | 0.6–0.8% |
| tungsten | 5–10% |
| vanadium | 2–4% |
| cobalt | 0.5–8.5% |
| manganese | 0.1–0.2% |
| nickel | 0.1–0.4% |

the balance being iron and less than 2% impurities.

13. A process as claimed in claim 11, wherein the copper phosphide contains 8 to 11% phosphorus.

14. A process as claimed in claim 11, wherein the copper phosphide contains 8% phosphorus.

15. A process as claimed in claim 11, wherein the sintered article is cooled at a rate which prevents hardening.

16. A process as claimed in claim 11, wherein the sintered article is heat-treated to increase its hardness and strength.

17. A process as claimed in claim 12, wherein the powder mixture is compressed to a compact of 65% to 80% theoretical density.

18. A powder mixture as claimed in claim 6, further including copper powder, copper alloy powder, graphite, or mixtures thereof.

19. A process as claimed in claim 11, wherein copper powder, copper alloy powder, graphite, or mixtures thereof is mixed with said ferrous alloy powder and copper phosphide powder prior to compressing the powder mixture.

* * * * *